US005851598A

United States Patent [19]

Gallant

[11] Patent Number: 5,851,598

[45] Date of Patent: Dec. 22, 1998

[54] METHOD FOR APPLYING A RELEASE COATING TO A ROLL

[75] Inventor: James O. Gallant, Attleboro, Mass.

[73] Assignee: Mount Hope Machinery Company, Taunton, Mass.

[21] Appl. No.: 848,448

[22] Filed: May 8, 1997

Related U.S. Application Data

[63] Continuation of Ser. No. 539,200, Oct. 4, 1995, abandoned.

[51] Int. Cl.[6] ..... B05D 3/06

[52] U.S. Cl. ..... 427/515; 427/503; 427/505; 427/516; 427/521

[58] Field of Search ..... 427/496, 500, 427/503, 505, 510, 514, 515, 516, 521

[56] References Cited

U.S. PATENT DOCUMENTS

| | | | |
|---|---|---|---|
| 2,393,191 | 1/1946 | Robertson . | |
| 4,180,615 | 12/1979 | Bettoli | 427/293 |
| 4,313,988 | 2/1982 | Koshar et al. | 427/503 |
| 4,675,234 | 6/1987 | Sachs et al. | 427/500 |
| 5,397,813 | 3/1995 | Eckberg et al. | 522/31 |

*Primary Examiner*—Katherine A. Bareford
*Attorney, Agent, or Firm*—Myers Bigel Sibley & Sajovec, P.A.

[57] ABSTRACT

Machine elements having Release Coatings that are Electromagnetic Wave Energy Cured, Highly Abrasion Resistant, Flexible, Low Friction, Release Coatings for Compliant Elastomeric Substrates used on Bowed Rolls and Press Rolls. 100% solids, highly abrasion resistant release coatings which are polymerization cured with electromagnetic wave energy in the wave length range of 5500 Å to 0.006 Å. These coatings will bond securely to commonly used structural and elastomeric, rigid and flexible, substrates; including metallic and non-metallic materials. The coatings are compositions of varying percentages of 2-Phenoxyethyl Acrylate, Tetraethylene Glycol Diacrylate, Isobutyl Benzoin Ether, 1,6 Hexanediol Diacrylate, Cycloaliphatic Bis A Epoxide, Polyurethane Acrylate, Methyl Methacrylate, Polysiloxane and other Acrylics, Tertiary Amines, Epoxidized Novolac, Fluorinated Alkyloxylate, Electromagnetic Wave Energy sensitive Photoinitiators, and Electromagnetic energy absorbers. Multiple coating layers and multiple frequencies of wave energy are employed to cure the coatings in order to achieve optimum adhesion to substrates combined with optimum release, flexibility, hardness, low friction, and abrasion resistance of coatings. The useable electromagnetic wave lengths range from long wave ultraviolet down to short wave gamma rays (i.e. 5500 Å to 0.006 Å). Electron beam bombardment can also be used without photoinitiators.

13 Claims, 12 Drawing Sheets

METHOD FOR APPLYING A RELEASE COATING TO A ROLL

This application is a continuation, of application Ser. No. 08/539,200, filed Oct. 4, 1995, now abandoned.

FIELD OF THE INVENTION

The field of this invention is finished coatings for rolls used in industrial applications, and more particularly, rolls having release coatings, methods for making such coatings, and methods for coating rolls.

The field of this invention also relates to machine elements used to transport and process a viscid web and, a method for transporting such a web.

BACKGROUND OF THE INVENTION

Covered rolls are used industrially in demanding environments where they are subjected to high dynamic loads and temperatures. Covered rolls are used not only for transporting the material under process, which is in the form of a travelling web, but also for processing the web itself into a finished product.

Bowed rolls are a particular kind of machine element used to correct distortions and similar problems by distributing lateral tension evenly across a travelling sheet material. For example, bowed rolls are used to spread out or expand the travelling web for the purposes of maintaining width, eliminating wrinkles, eliminating baggy centers or slack edges. Bowed rolls are also used to control felts by maintaining their width, openness and seams, and to eliminate interleaving of individual slit webs on winders.

Press rolls are yet another kind of machine element used in nip presses. Press rolls process the travelling web by compressing the web at the nip. Typically this is done to remove liquids from the web, e.g., dewatering presses, or to eliminate high and low spots in a finished product, e.g., finish nip presses.

U.S. Pat. No. 2,393,191 issued to John Robertson, discloses how the transfer of sticky viscid materials onto the roll and ultimately into the ball bearings causes rapid gumming of the races and failure of the roll. Robertson also discloses an expander roll having a rubber cover which allows delicate web sheet fabrics to be processed without tearing.

Bowed rolls with elastomeric sleeves and press rolls with compliant elastomeric covers are machine elements used in applications where the web under process is coated with surface enhancing materials that are tacky and subject to transfer to any surface in contact with the web. In general, the transfer of viscid materials from the web to the surface of the roll results in the degradation of the roll's surface and the web's surface. Therefore, it is desirable to have such rolls coated with a material that is, inter alia, self-cleaning, i.e., has high release properties. Rolls covered with release coatings prevent excessive sticking which ultimately allows the "release" of the viscid material from the roll surface.

Industrial web processing applications in the paper, textile and plastics industries, are enhanced through the use of covered rolls with surfaces that have high resistance to abrasion, optimum release properties, flexibility and low coefficients of friction. At present, industrial needs are met by rolls having surfaces treated with epoxies, urethanes, Teflon polymers, silicones or waxes. Epoxies and urethanes have desirable abrasion resistance properties, but lack the desired high release properties and low coefficients of friction. Teflon polymers and silicones have high release properties and low coefficients of friction, but lack high abrasion resistance qualities. Waxes and silicone polish coatings do not last very long.

The flexing surfaces of bowed rolls and press rolls must have good coating release properties, low coefficients of friction, high flexibility, and good abrasion resistance. The materials that are presently being used to cover these machine elements are Teflon shrink tubing, sintered Teflon polymer coatings and silicones. These coatings are expensive, subject to excessive wear rates, and exhibit poor adhesion to substrates. Often, they are rendered useless by minor cut damage from the mechanical removal of the web coating material which adheres to the Teflon polymer, and must be removed manually. Thus, the need exists to develop rolls with coatings that are harder, have lower coefficients of friction and improved release properties, with lower wear rates than present day covered rolls.

SUMMARY OF THE INVENTION

The problems caused by prior art coatings, are reduced in accordance with the present invention through the application of a release coating to the surface of a roll or machine element. The coating of the present invention is harder, and has a lower coefficient of friction, better release properties and wear rates than those of Teflon polymers.

In accordance with this invention, it has been found that a liquid solution of varying percentages of 2-Phenoxyethyl Acrylate, Tetraethylene Glycol Diacrylate, Isobutyl Benzoin Ether, 1,6 Hexanediol Diacrylate, Cycloaliphatic Bis A Epoxide, Polyurethane Acrylate, Methyl Methacrylate, Polysiloxane and other Acrylics, Tertiary Amines, Epoxidized Novolac, Fluorinated Alkyloxylate, Electromagnetic Wave Energy sensitive Photoinitiators, and Electromagnetic Energy absorbers, composed of 8% to 24% by weight of polysiloxane will produce a liquid phase reaction of the polysiloxane and acrylated epoxy creating a suspended precipitate of Epoxidized polysiloxane in a predominantly Polyurethane acrylate and monomer solution.

It is an object of the present invention to provide a coating that can be applied to metallic or nonmetallic surfaces.

Another object of this invention is to provide a method of coating a machine element with a release coating.

Another object of this invention is to provide a method of curing the coated surface of a machine element with Electromagnetic Wave Energy.

Another object of this invention is to provide a method of curing the coated surface of a machine element with Electron Beam Bombardment.

Another object of this invention is to provide a method of curing the coated surface of a machine element with Ultraviolet Light Radiation.

Another object of the present invention is to provide a coating for a machine element that is hard enough to be abrasion resistant while having high release properties.

Another object of the present invention is to provide a coating for a machine element that is abrasion resistant while having a low coefficient of friction.

Another object of the present invention is to provide a coating for a machine element that has improved release properties.

Another object of the present invention is to provide a coating for a machine element that has lower wear rates than prior art coatings.

Another object of the present invention is to provide a coating for a machine element that has wear rates that are lower than that of a Teflon polymer.

Another object of the present invention is to provide a coating for a machine element that is abrasion resistant.

Another object of the present invention is to provide a coating for a machine element that is abrasion resistant yet complaint enough to be applied to machine elements requiring flexible surfaces.

Another object of the present invention is to manufacture covered machine elements having release coatings applied as a liquid composition of 100% solids and/or solvent thinned solids.

Another object of the present invention is to apply a release coating to machine elements located on site, i.e., at the user's facility.

Another object of the present invention is to provide a new and improved roll having better release properties.

Another object of the present invention is to provide an improved method of processing a viscid web using rolls with improved release properties.

Another object of the present invention is a method of applying a release coating utilizing a minimum of solvents.

DESCRIPTION OF THE PREFERRED EMBODIMENT

Figure 1:
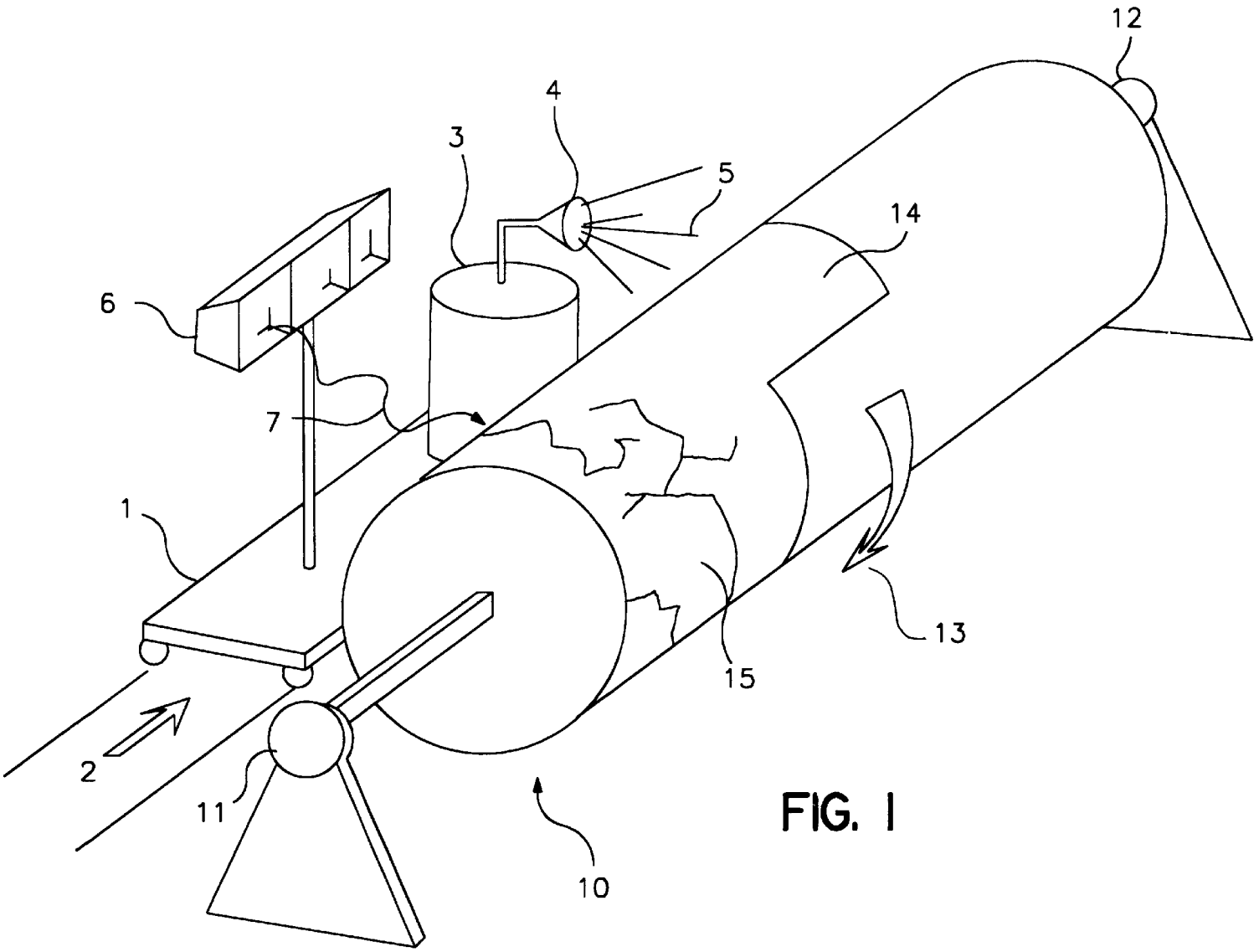
FIG. 1 is a perspective view illustrating the application of the adhesive coating to a machine element in accordance with the present invention.

At the outset, a roll having a release coating, the associated method for making the coating and applying it to the roll, and a method for transporting a viscid web, are described in their broadest overall aspects with a more detailed description following.

In its broadest overall aspects, the release coating of the present invention is a composite coating, comprising multiple layers of release coating applied over an initial adhesive layer.

In manufacturing the initial adhesive layer of the present invention, a liquid composition of 100% solids and/or solvent thinned solids is prepared from what is essentially acrylated epoxy, acrylated urethane and acrylated monomer. Then the adhesive mix is applied to form an initial layer on the machine element utilizing conventional methods, such as a sprayer.

In its broadest overall aspects, the release coating of the present invention comprises the addition of acrylated polysiloxane to the adhesive mix which produces a liquid phase reaction of the acrylated polysiloxane and acrylated epoxy, thereby creating a suspended precipitate of epoxidized polysiloxane in a predominantly polyurethane acrylate and acrylated monomer solution. Thus, the release coating is a liquid composition of 100% solids and/or solvent thinned solids prepared to form a pre-reacted solution that is essentially an epoxidized-siloxane matrix in acrylated urethane and acrylated monomer. Then the pre-reacted solution is applied over the adhesive layer on the machine element utilizing conventional methods, such as a sprayer.

The release coating, including the initial adhesive coating, of the present invention can be applied to machine elements located at end-users' facilities, thus reducing manufacturing costs and facilitating emergency repairs. The adhesive and release layers can either be prepared concurrently in separate mixing vats or consecutively by adding the acrylated polysiloxane subsequent to the application of the initial adhesive layer.

The adhesive and pre-reacted release coatings can be applied to flexible or rigid substrates, such as, bowed rolls, press rolls or carrying rolls. Through the addition of photoinitiators, both the adhesive and release coatings can be cured using Electromagnetic Wave Energy in the wave lengths ranging from about 5500 Å. through 006 Å, i.e., long wave ultraviolet down to short wave gamma rays. Alternatively, Electron Beam Bombardment can be used to cure the coatings without the use of photoinitiators.

TABLES 1 and 2 summarize the chemical ingredients used to create the liquid oligomers for the adhesive and release coating layers, respectively. As used throughout this specification and the claims, all percentages are by weight unless otherwise specified.

The chemicals listed in TABLE 1 are mixed together to make the solution for the initial adhesive coat in the proportions as indicated. Each of the ingredients can be varied as indicated by the range of percentage amounts in TABLES 1 and 2. However, any increase of one ingredient must be compensated by a corresponding decrease in other components.

TABLE 1

| Adhesive Coating Chemical Composition By Weight Percentage | |
|---|---|
| Ingredient | Range |
| Acrylated Monomer | 35.6–59.4 |
| Acrylated Polyurethane | 14–39 |
| Acrylated Epoxy | 11–27 |
| Free Radical Photoinitiator | 2–6 |

TABLE 2

| Release Coating Chemical Composition By Weight Percentage | |
|---|---|
| Ingredient | Range |
| Acrylated monomer | 28–52 |
| Acrylated polyurethane | 10–35 |
| Acrylated epoxy | 9–26 |
| Polysiloxane | 8–24 |
| Cationic Photoinitiator | 1–3 |
| Free Radical Photoinitiator | 1–5 |

Generally, 2 Phenoxyethyl Acrylate and Tetraethylene Glycol Diacrylate and 1,6 Hexanediol Diacrylate are polyacrylates that comprise the acrylated monomer. Cycloaliphatic Bis A epoxy diacrylate is an example of a commonly used acrylated epoxy. Typically, Urethane Diacrylate is combined with 1,6 Hexanediol Diacrylate to lower viscosity in the acrylated polyurethane. Isobutyl Benzoin Ether is an example of a commonly used free radical photoinitiator, while a Triarylsulfonium Hexaflouroantimonate salt is commonly used as a cationic photoinitiator.

Other equivalent ingredients can be used to augment or substitute the ingredients listed TABLES 1 and 2. Epoxidized Novolac is an alternative epoxy which imparts further abrasion resistance and hardness to the final product, if so desired, as for example in a press roll. Tertiary amines are additive adjuncts to photoinitiators which extend the curing beyond the Ultraviolet Cure Phase. A Methacrylate, such as Glycidylmethacrylate, for example, can be used as an alternative highly reactive monomer, and when added, Flourinated Alkyloxylate imparts additional release properties to the coatings.

In general, to manufacture a coated machine element of the present invention, 9 to 26 by percentage weight acrylated epoxy, 10 to 35 by percentage weight acrylated urethane, 8 to 24 by weight acrylated polysiloxane, 28 to 52 by percentage weight acrylated monomer, and 2 to 8 by percentage weight of cationic and free radical photoinitiators are initially mixed together to form a mixture of liquid oligomers in a mixing vat.

In its broadest overall terms, the release coating of the present invention comprises oligomers of acrylated epoxy, acrylated urethane, acrylated siloxane and acrylated monomer. Ultimately, it is the acrylated epoxy and acrylated urethane components which provide abrasion resistance properties to the coating while the acrylated urethane and acrylated monomer components add compliance and flexibility. The epoxidized siloxane precipitate further imparts hardness and high release properties to the coating.

Photoinitiators are added to the oligomers to cross-link the pre-reacted solution upon the application of Electromagnetic Energy. Electromagnetic Radiation of a machine element covered with the release coating of the present invention, causes the photoinitiators to generate free radicals and cationic particles which initiate the formation of cross-linking bonds among the polymers and the siloxane. Several different kinds and combinations of photoinitiators can be used as described in the text, "Radiation Curing Science and Technology," Edited by S. Peter Papas, (1992 Plenum Press), the teachings of which are hereby incorporated by reference.

FIG. 1 illustrates how the adhesive coating of the present invention is applied to a roll 10 mounted rotatably in bearings 11 and 12. Arrow 13 indicates the direction of roll 10, which is arbitrary. A traverse carriage 1 travels back and forth alongside roll 10. For purposes of illustration, traverse carriage 1 is shown moving in the direction of arrow 2. Mixing vessel 3 which contains the oligomers comprising the adhesive coating, and ultraviolet lamps 6 are mounted on top of traverse carriage 1. Sprayhead 4 applies liquid adhesive coating 5 to coat roll 10 to form a first layer 14 for subsequent bonding of additional release coating layers thereto. Ultra-violet lamps 6 radiate long wave-length Electromagnetic Energy 7 to effect a partial cure of the adhesive layer 14. This creates good adhesion between the initial adhesive layer 14 and roll 10, and provides a partially reacted reactive film 15 on the outer surface for subsequent bonding with additional layers of release coating.

Figure 2:
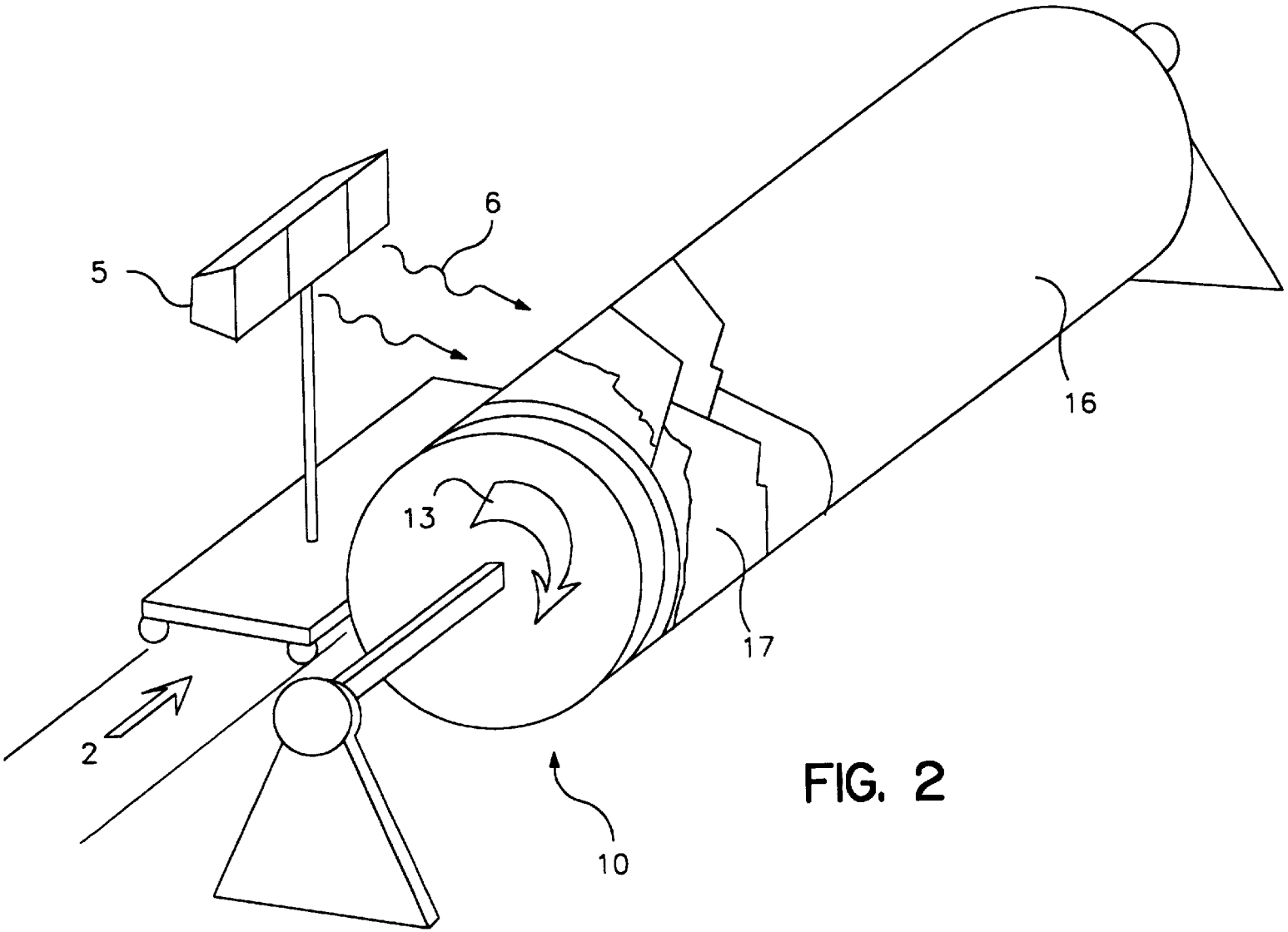
FIG. 2 is a perspective view illustrating the step of curing of a final release layer on a machine element to form a release coating in accordance with the present invention.

The pre-reacted liquid oligomer mixture comprising the release coating is applied in the same manner as with the adhesive coating. Similar to FIG. 1, FIG. 2 shows how a roll 10 of the present invention is finally cured with ultraviolet lamps 5 which radiate Electromagnetic Wave Energy 6. Arrow 13 indicates the rotational direction of roll 10, which is arbitrary. FIG. 2 further shows symbolically how final layer 16 is cured to form a finished release coating 17 which is a matrix composed of hard sites of cross-linked Epoxidized Polysiloxane Acrylate dispersed in a flexible lower modulus binder of cross-linked polyurethane acrylate and acrylated monomer. Electromagnetic Wave Energy transparent reinforcing fillers (not shown) may be used to increase individual coating film thickness and reduce production costs.

Figure 3:
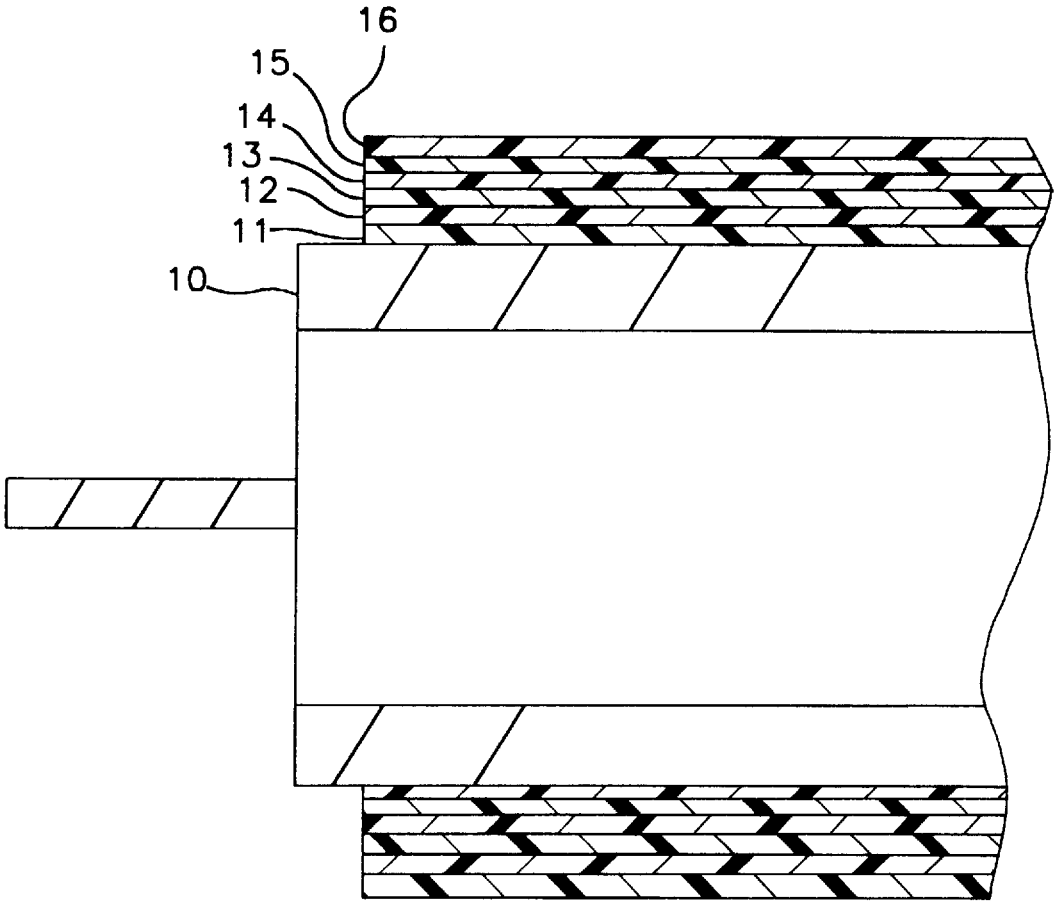
FIG. 3 is a sectional view illustrating a machine element covered with the release coating in accordance with the present invention having a multiplicity of release layers applied over an adhesive substrate layer.

FIG. 3 shows one embodiment of the present invention is a cylindrical machine element covered with multilayers of release coating. Metal roll 10 is coated with an initial adhesive layer 11 that has been partially cured. This is followed by the application of multiple layers of release coating containing polysiloxane, layers 12 through 16, until a flexible, abrasion resistant release layer of desired thickness is formed.

With respect to FIGS. 1–3, the final coating comprised of all layers is cured with more intense and shorter wave length energy. Throughout the application process, multiple coating layers and multiple frequencies of wave energy are employed to cure the coatings in order to achieve optimum adhesion to substrates combined with optimum release, flexibility, hardness, low friction, and abrasion resistance of coatings.

The degree of flexibility or rigidity of the cured coating can be controlled by the percentages of acrylated epoxy and acrylated urethane used in the solutions. The reacted liquid phase of the coating contains 1–4% of a combination of free radical and cationic particle generating photo-initiators which react with electromagnetic wave energy (e.g., ultraviolet light) to effect a hard cure of the liquid coating.

With further reference to FIGS. 1–3, the initial adhesive coat 11 is composed of acrylated polyurethane, acrylated epoxy and acrylated monomers. The subsequent additional multiple layers, layers 12–16, contain the epoxidized polysiloxane precipitate matrix suspended in polyurethane acrylate and acrylated monomer. This combination provides extremely good adhesion to substrates combined with a thick multi-layered coating with good hardness, and release properties throughout the depth of the coating, instead of the poorly adhered silicone rich surface which results from small additions of polysiloxane, 0.5–2% by weight for example, and which does not last long in a web processing application.

Figure 4A:
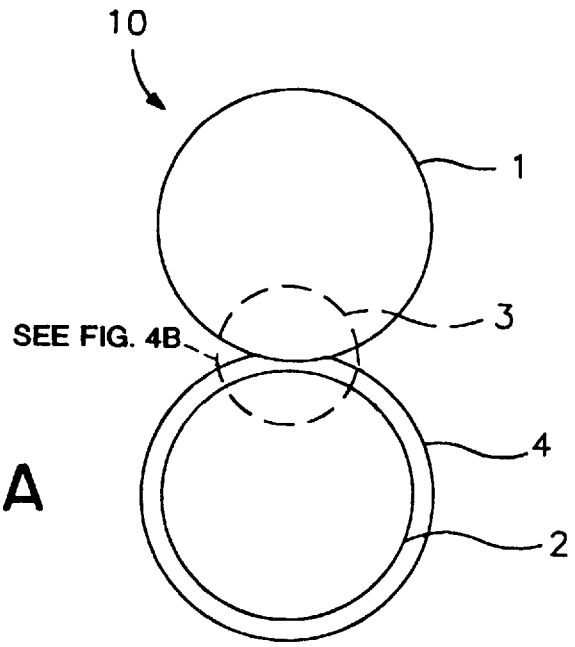
FIG. 4A is a sectional view illustrating a nip press having a lower cylindrical roll covered with the release coating of the press invention.
Figure 4B:
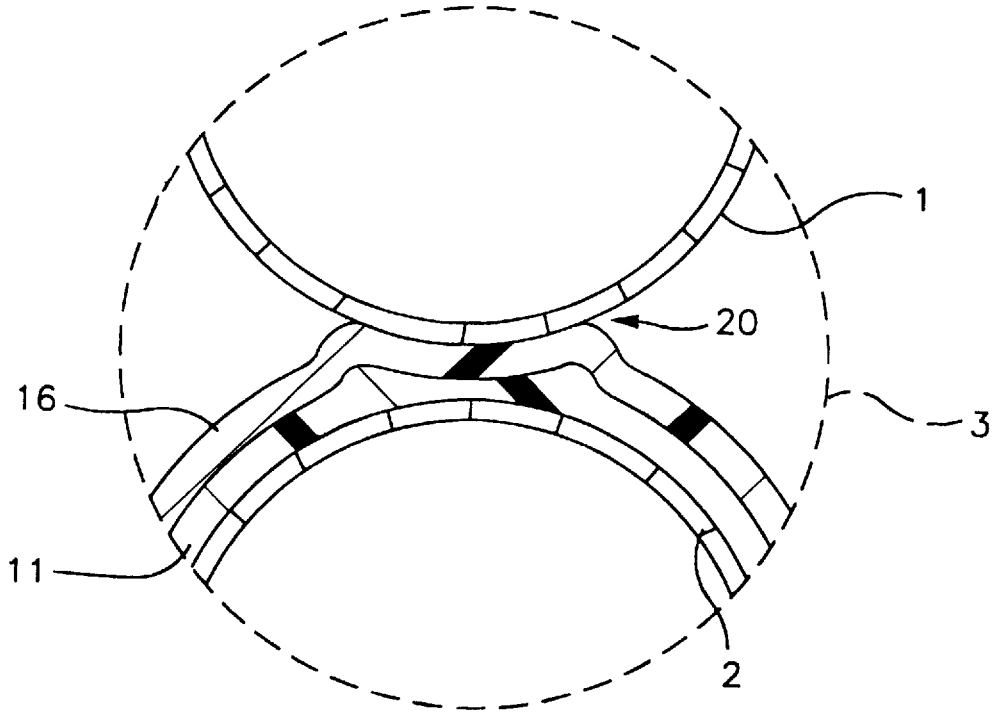
FIG. 4B is an expanded sectional view of the encircled area in FIG. 4A illustrating how the flexible release coating of the present invention can withstand a nip deformation.

FIGS. 4A and 4B show a nip press 10 having upper and lower cylindrical machine elements 1 and 2 respectively. The lower machine element 2 is coated with a flexible release coating 4 of the present invention. (For illustrative purposes, the travelling web or sheet under process is not shown.) FIG. 4B, which is an enlargement of encircled area 3 in FIG. 4A, shows lower machine element 2 coated with the release coating of the present invention comprising initial adhesive layer 11 and multiple layers of release coating 16 which have been applied as described above. FIG. 4B also shows how the release coating of the present invention must have enough flexibility to withstand a nip deformation 20.

Figure 5A:
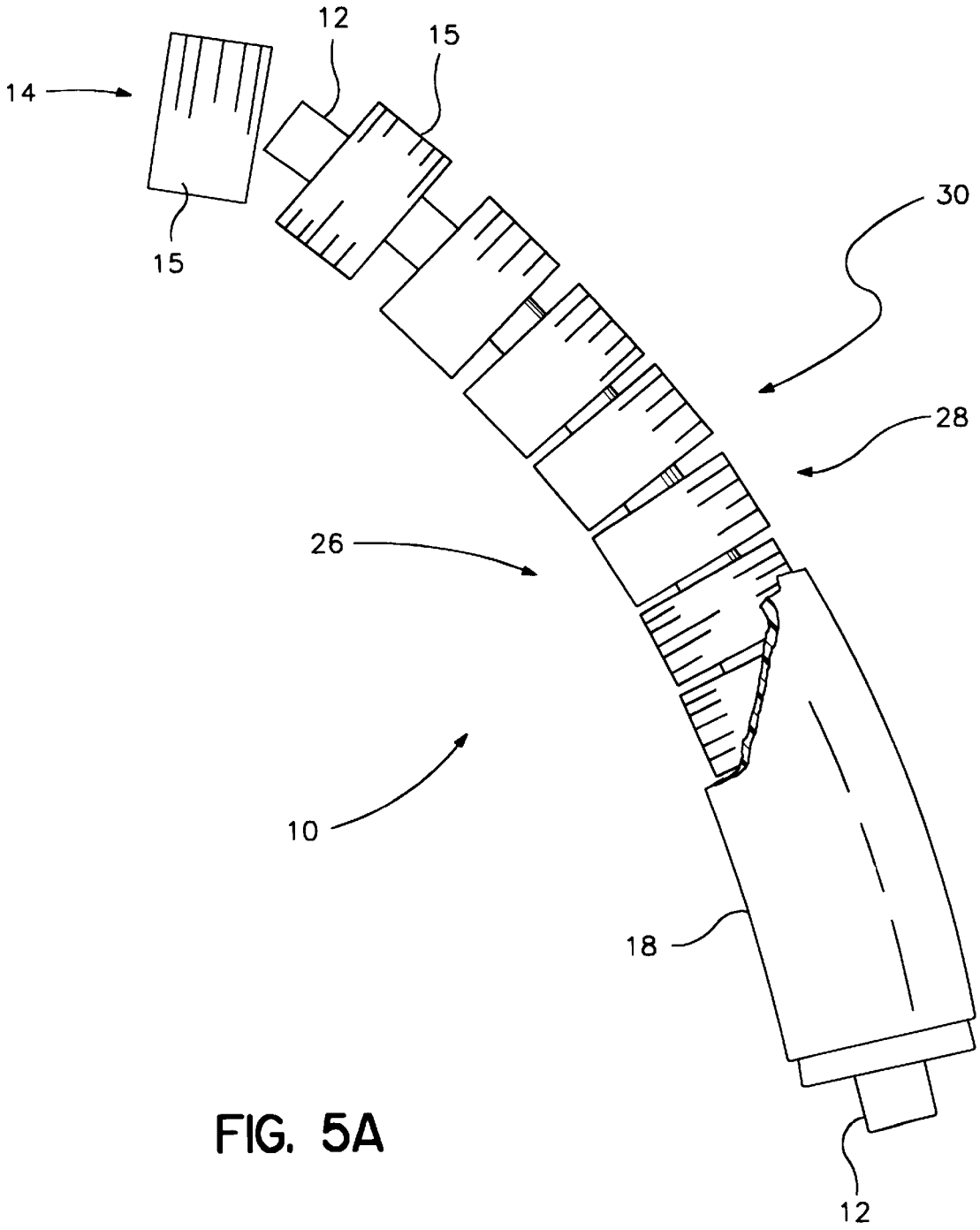
FIG. 5A is a plan view of a bowed roll illustrating an elastomeric roll cover coated with a release coating in accordance with the present invention.

FIG. 5A shows generally how a bowed roll 10 consists of three basic elements. A non-rotating axle 12 that is curved to provide the degree of bow required for a specific application. A plurality of specially designed ball bearing assemblies 14 mounted on axle 12 so that the outer races (not shown) of ball bearing assemblies 14 are free to turn, while inner races of the ball bearing assemblies (not shown) are held stationary on axle 12. With further reference to FIG. 5A, outer shell 15, or spool as commonly referred to in the art, is affixed to the outer race of each bearing assembly 14. A special elastomeric sleeve 18 made out of flexible rubber is assembled over the outer shells 15 of ball bearing assemblies 14. Bowed roll 10 has concave side 26 and convex side 28 with an apex shown approximately by arrow 30. Although not shown, bowed roll 10 is mounted in special mounting brackets which allow the roll to be mounted at any angle to vary the location of the roll's apex 30 with respect to the traveling web under process.

In operation, flexible sleeve 18 expands with rotation from the concave side 26 of curved axle 12 to the convex side 28. The bowed roll is set so the web approaches the roll on concave side 26 and leaves on convex side 28. In this way the web is spread out in the cross machine direction. Setting of the bow direction is easily accomplished by rotating axle 12 in special mounting brackets, (not shown).

Figure 5B:
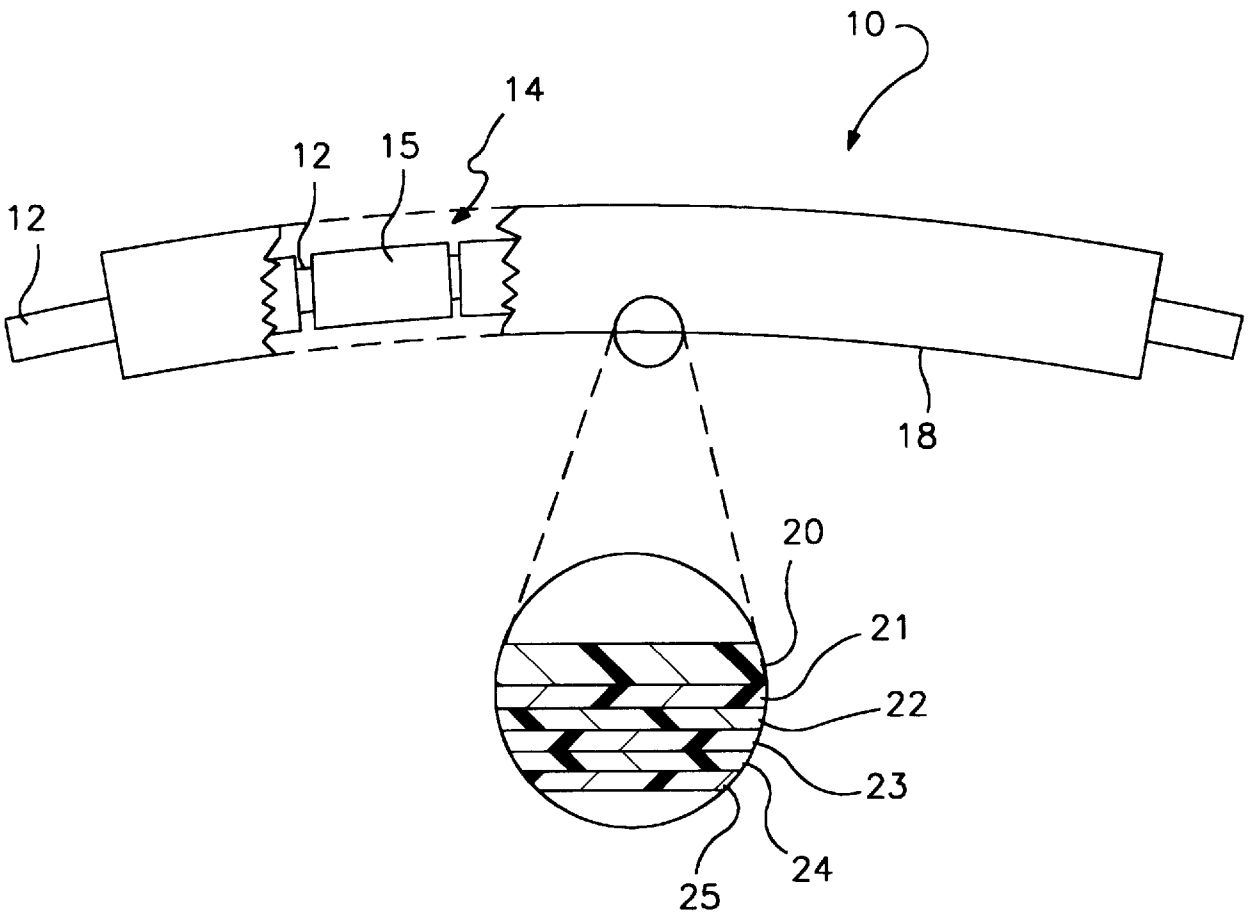
FIG. 5B is partially sectioned view of a bowed roll illustrating the adhesive and multiple release layers in accordance with the release coating of the present invention.

FIG. 5B is a partial cutaway of bowed roll 10 of the present invention which shows a flexible sleeve 18 covered with an adhesive layer 20 and a multiplicity of release layers 21–25 according to the present invention.

Although not shown, bowed rolls without elastomeric sleeves may have each outer shell 15 of each individual bearing assembly 14 covered with the coating of the present invention.

Figure 6A:
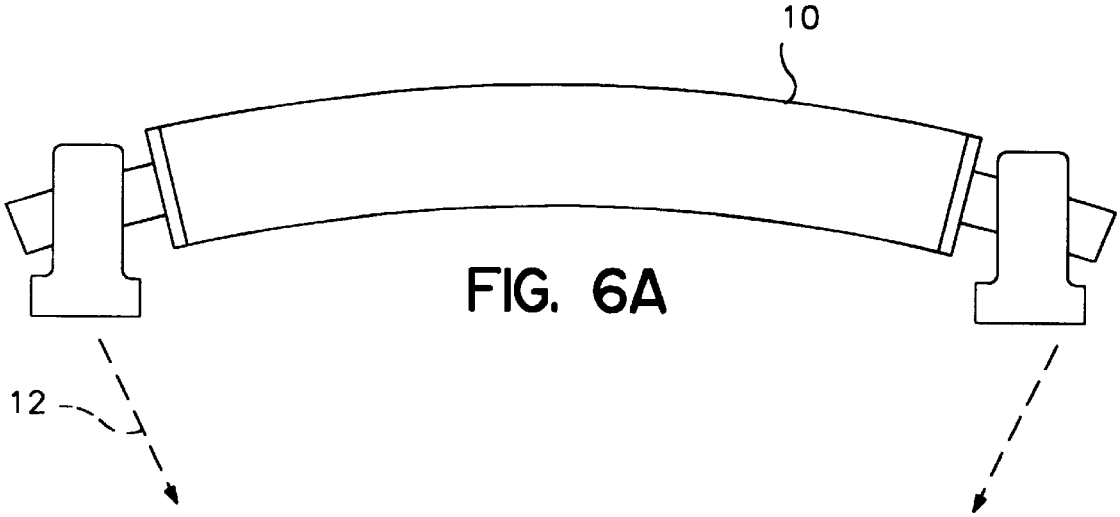
FIG. 6A is a side view illustrating a bowed roll covered with the release coating in accordance with the present invention.
Figure 6B:
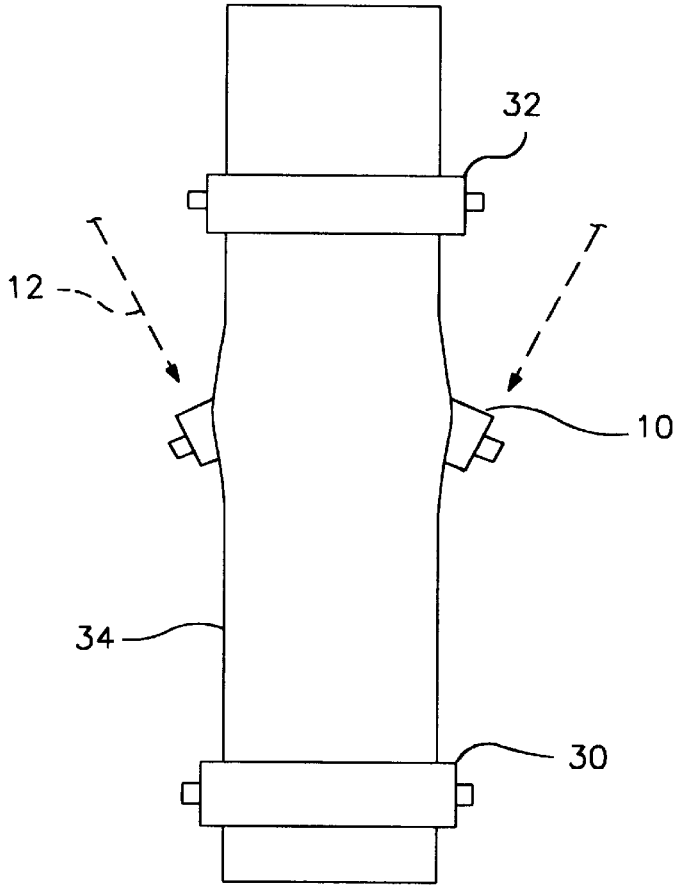
FIG. 6B is a diagram illustrating the placement of bowed rolls in processing a viscid web in accordance with the present invention.

FIG. 6A is a side view of a bowed roll covered with the release coating of the present invention. FIG. 6B and phantom lines 12 show how bowed roll 10 may be located between guide rolls, lead-in 30 and lead-out 32, respectively, to expand travelling web 34. The spreading of travelling web 34, (or felt), starts when the web 34 leaves lead-in roll 30 which is directly before bowed roll 10. As the web 34 leaves bowed roll 10, spreading is complete. To prevent the web's tendency of reverting back to its original state, lead-out roll 32 is proximally located after bowed roll 10. The closer bowed roll 10 is to the next roll in process, the better the job of "locking in" the spreading that is accomplished. Also by varying the configuration of bowed roll 10, web 34 can be spread evenly from the center to both outside edges of the roll, or spread more at the center than the edges to correct baggy centers, or more at the edges to correct slacking edges.

The present invention is further illustrated by the following non-limiting example.

In this specific example, the adhesive and release coatings, are comprised of the solutions tabulated by percentage weight in TABLES 3 and 4, respectively. As a corollary to TABLE 4 and as used throughout this specification and claims, TABLE 5 lists the various chemicals of TABLE 4 with their average molecular weights and chemical structures using Lewis structures as is known in the art. Where applicable, commonly used acronyms are also listed in parenthesis.

TABLE 3

(SPECIFIC EXAMPLE)
Adhesive Coating Chemical Composition By Weight Percentage

| Ingredient | % |
|---|---|
| 2 Phenoxyethyl Acrylate | 44 |
| Tetraethylene Glycol Diacrylate | 4.4 |
| 1,6 Hexanediol Diacrylate | 20 |
| Cycloaliphatic Bis A Epoxy Diacrylate | 20 |
| Polyurethane Diacrylate | 6 |
| Isobutyl Benzoin Ether | 5.6 |

TABLE 4

(SPECIFIC EXAMPLE)
Release Coating Chemical Composition By Weight Percentage

| Ingredient | % |
|---|---|
| 2 Phenoxyethyl Acrylate | 36 |
| Tetraethylene Glycol Diacrylate | 3 |
| 1,6 Hexanediol Diacrylate | 16 |
| Cycloaliphatic Bis A Epoxy Diacrylate | 16 |
| Polyurethane Diacrylate | 5 |
| Polysiloxane (Poly)Methoxy(Meth)acrylate Siloxane | 16 |
| Triarylsulfonium Hexaflouroantimonate | 3 |
| Isobutyl Benzoin Ether | 5 |

TABLE 5

| Average Molecular Weight (AMW) and Chemical Structure |
|---|

2 Phenoxy Acrylate, (2-PEA)
AMW: 192

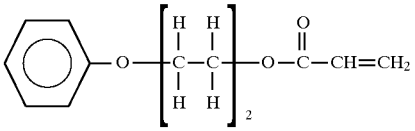

Tetraethylene Glycol Diacrylate (TEGDA)
AMW: 302

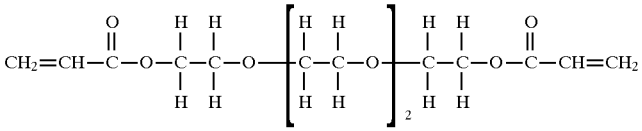

1,6 Hexanediol Diacrylate (HDODA)
AMW: 226

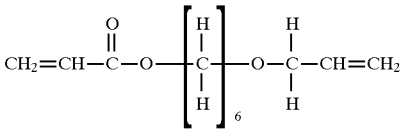

Cycloaliphatic Bis A Epoxy Diacrylate;
AMW: 525 + 252, (BLEND/MIXTURE)

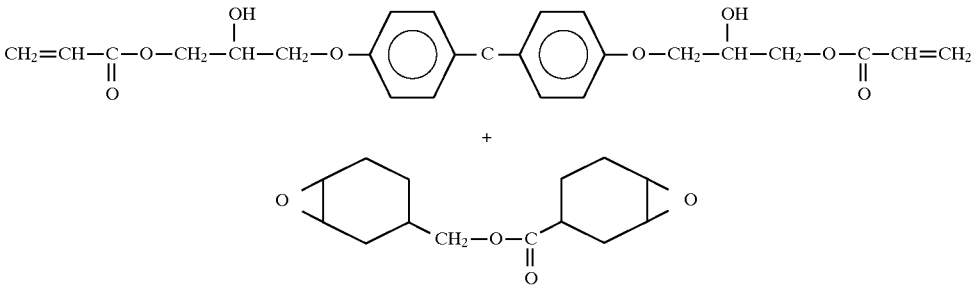

(Poly)urethane Diacrylate
AMW: 1500

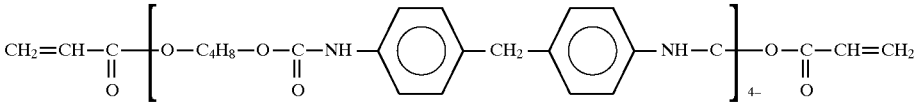

(Poly)Methoxy(Meth)acrylate Siloxane
AMW: 244

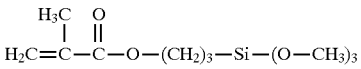

Triarylsulfonium Hexaflouroantimonate; AMW: 607 + 1028

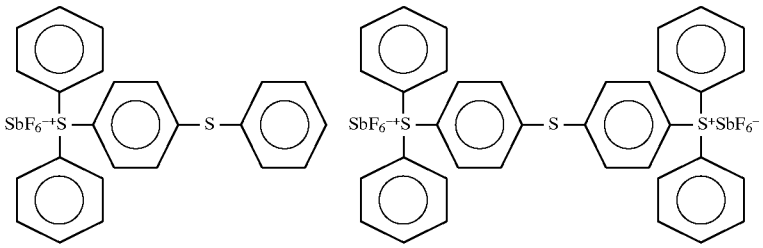

Isobutyl Benzoin Ether, (IBBE); AMW: 268;

TABLE 5-continued

| Average Molecular Weight (AMW) and Chemical Structure |
|---|
| 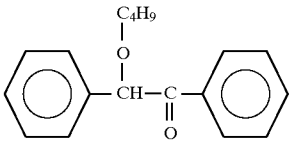 |

The solutions which comprise the adhesive and release coatings, respectively, are mixed in separate mixing vessels for 15 minutes before use and continuously thereafter, throughout the application of the coating to the machine element. Both coating materials, adhesive and release coating solutions, are held at elevated temperature, preferably on the order of about 150° F., and are continuously-mixed in their respective pressure vessels, preferably at a mixing speed of 200 rpm. The preferred cationic photoinitiator is Triarylsulfonium Hexaflouroantimonate and the preferred Free Radical Photoinitiator is Isobutyl Benzoin Ether.

Figure 7:
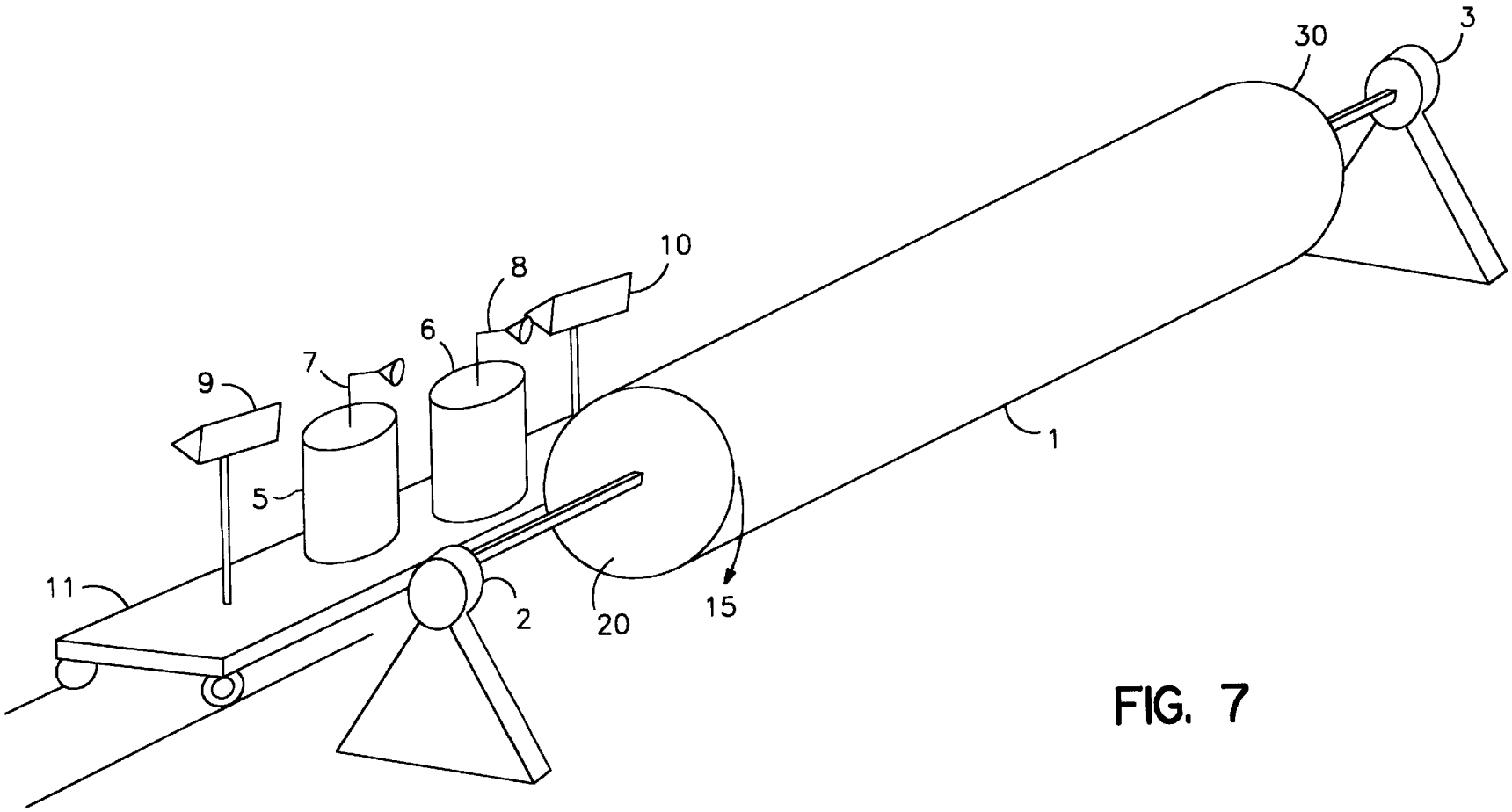
FIG. 7 is a perspective view illustrating the application of a release coating to a machine element in accordance with the specific example of the present invention.

With reference to FIG. 7, roll 1 is mounted rotatably in bearings 2 and 3. The adhesive and release coating chemical compositions of Tables 3 and 4 are contained in reservoirs 5 and 6 respectively having sprayheads 7 and 8 respectively and supported on a traversing carriage 11. Curing energy sources 9 and 10 are mounted on both sides of spray heads 7 and 8 to allow coating and curing in both traversing directions. The spray application system is composed of low pressure, pressurized liquid feed vessel and a high volume head applicator gun.

In this specific example and with further reference to FIG. 7, the adhesive coating admixture, (TABLE 3), is applied with a gun pressure of 50 psi from mixing vessel 5 through sprayhead 7 to form an initial substrate layer on the surface of the rotating roll with a film thickness of approximately 0.003". Both coating materials, adhesive and release coating solutions, are held at elevated temperature, preferably on the order of about 150° F., and are continuously-mixed in their respective pressure vessels, 7 and 8, preferably at a mixing speed of 200 rpm. As indicated by arrow 15, the rotational surface speed of roll 1 is approximately 30 feet per minute while the speed of carriage traverse 11 varies with the diameter of roll 1. In this specific example, a roll having a diameter of 7" requires the traverse speed to be 60" per minute. The adhesive layer application starts at end 20 of roll 1 and proceeds beyond the end 30 while following curing energy source 9 is activated to effect a partial cure of the applied coating layer. Each energy source 9 and 10 consists of 12" long focused ultraviolet lamps that deliver 450 watts per inch of lamp length.

Then the second coating layer which is the first release layer is applied over the initial adhesive layer in the opposite direction from end 30 to end 20, using second traversing energy source 10 to partially cure that layer. Traversing from end to end, the procedure of applying additional layers of the release coating is repeated until a desired coating thickness of 0.060" is applied and partially cured. After applying the final layer of release coating, the carriage traverse speed is reduced to 20" per minute and both curing energy sources 9 and 10 are used to increase radiation energy per square inch of coating by a factor of six to complete the radiant energy curing of the coating. Further post cure is accomplished by moisture, and room temperature thermal curing for several days. The over spray is removed from the air through a filtered exhaust system.

The release coating manufactured in accordance with the above has the properties indicated in TABLES 5 & 6.

TABLE 5

| Release values in pounds per inch of bond line using Scotch brand No. 230 3M Drafting and Universal Brand No. 51301 Masking Tape. | | |
|---|---|---|
| | 3M 230 | Universal 51301 |
| UV Release Coating | .08 | .25 |
| Teflon polymer Tube | .11 | .38 |

TABLE 6

| Coefficient of Friction of Kraft Paper on Coating Surface | |
|---|---|
| UV Release Coating | .07 |
| Teflon Polymer Tube | .09 |

This coating can also be applied to rolls that are installed in process machines located at end users production facilities using transportable portable application and over spray accumulating filtered exhaust systems.

Figure 8:
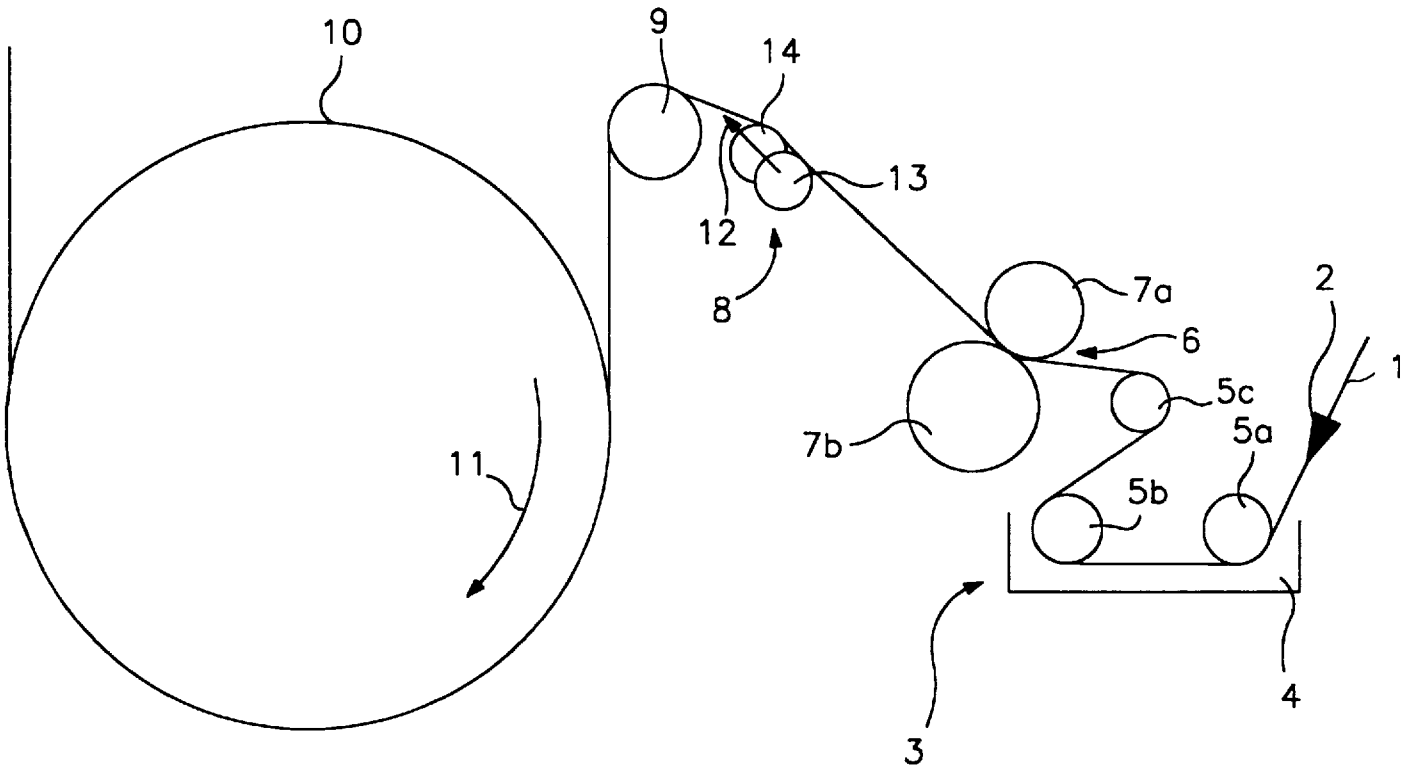
FIG. 8 is a diagram illustrating how a bowed roll located in spaced relationship with press rolls and a size bath are used to coat paper in the paper making industry.

Rolls having release coatings in accordance with the present invention are advantageously employed in mills for making sized, filled and coated paper. Referring to FIG. 8, a process is shown diagrammatically for coating paper including press and bowed rolls covered with the release coating of the present invention. As shown in FIG. 8, web 1 from the direction indicated by arrow 2 enters size bath 3 containing viscid liquid coating 4. As Web 1 is completely coated it is processed under and over several carrying rolls 5*a*–5*c* respectively, and passed through nip press 6 comprised of press rolls 7*a* and 7*b*. Then web 1 is spread by bowed roll 8 and carrying roll 9 prior to the removal of moisture and curing by heated roll 10 rotating in the direction indicated by arrow 11. Arrow 12 and circles 13 and 14, represent bowed roll 8 and form a symbol well known in the art used to indicate bow direction. This conventional symbol of a double circled arrow is used throughout FIGS. 8 through 11. With specific reference to FIG. 8, the double circled arrow symbolically indicates bow direction from side 13 to apex 14 of bowed roll 8. As known in the art, the higher the apex 14 with respect to side 13, indicated by arrow 12 being rotated into web 1, the greater the amount of spreading to eliminate baggy centers. Conversely, as apex 14 of bowed roll 8, (or arrow 12), is rotated away from web 1, the greater the degree of spreading towards the edges of the web 1 to eliminate slacking edges. When the release coating of the present invention is applied to the machine elements described above, the travelling web 1 does not stick to the various roll surfaces.

Figure 9:
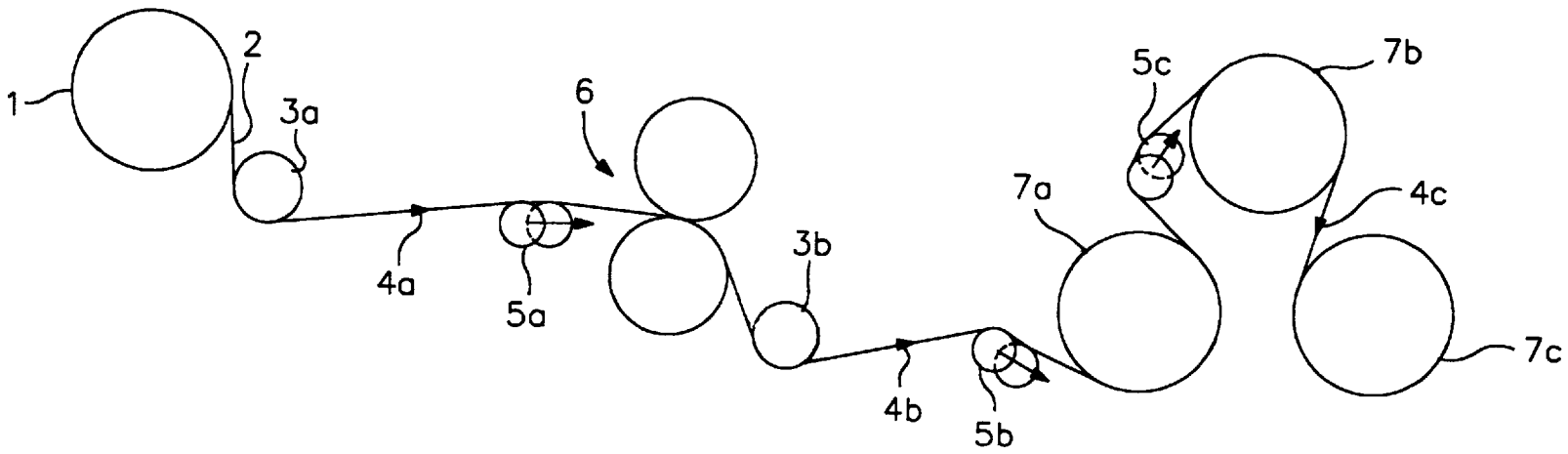
FIG. 9 is a diagram illustrating a system of machine elements used to transport a viscid web in the paper making industry.
Figure 10:
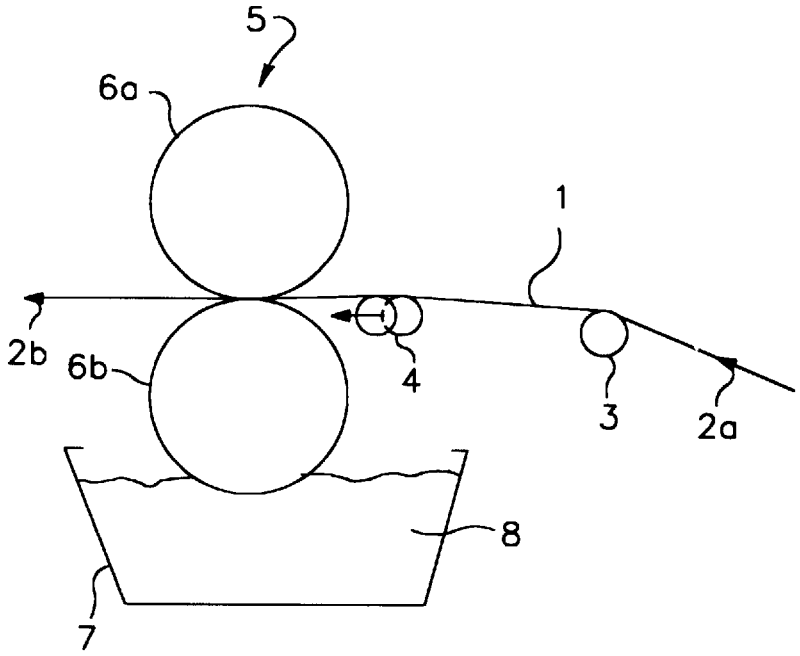
FIG. 10 is a diagram illustrating a coating process in the paper making industry.
Figure 11:
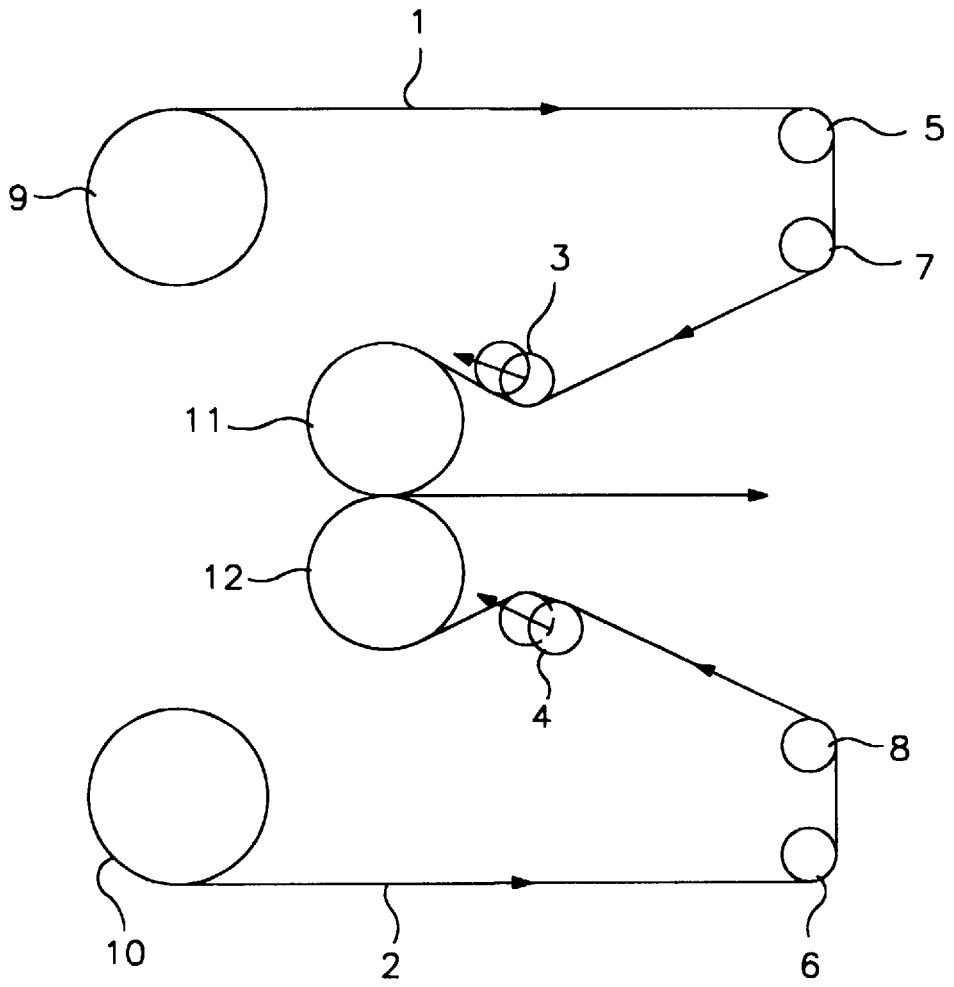
FIG. 11 is a diagram illustrating a system of machine elements used to transport and laminate two viscid webs in a paper making laminating process.

FIG. 9 shows diagrammatically how feed roll 1 supplies web 2 over carrying rolls 3*a* and 3*b* in the direction shown by arrows 4*a*, 4*b* and 4*c*. Bowed roll 5*a* covered with the release coating of the present invention, is located before size press 6 and maintains web 2 under even crosswise tension before saturation with viscid matter. Bowed rolls 5*b* and 5*c* are covered with the release coating of the present invention, and in conjunction with drier rolls 7*a*, 7*b* and 7*c*, are used to eliminate wet wrinkles and control baggy centers and slack edges. FIG. 10 illustrates diagrammatically how web 1 travelling in the direction indicated by arrows 2*a* and 2*b* passes over carrying roll 3, bowed roll 4 and through coating station 5 comprising press rolls 6*a* and 6*b*, and coating bath 7 which contains viscid matter 8. Bowed roll 4 which is covered with the release coating of the present invention, is located ahead of a coating station to eliminate wrinkles. Although not shown, bowed roll 4 can be alternatively located after the coating station. FIG. 11 illustrates the lamination of sheets 1 and 2 and shows how bowed rolls 3 and 4 and carrying rolls 5, 6, 7 and 8, covered with the release coating of the present invention, can be arranged to keep sheets 1 and 2 wrinkle free and under even tension thereby avoiding air bubbles in the lamination. Also shown are supply rolls 9 and 10, and press rolls 11 and 12.

In accordance with the present invention, the web 1 under process does not stick to the rolls and the machine elements involved do not gum up.

In the foregoing specification, the invention has been described with reference to specific exemplary embodiments thereof. It will, however, be evident that various modifications and changes may be made thereunto without departing from the spirit and scope of the invention as set forth in the appended claims. The drawings and specification are, accordingly, to be regarded in an illustrative rather than in a restrictive sense.

What is claimed is:

1. A method of of applying a release coating to the surface of a machine element, said method comprising the steps of:

(a) mixing liquid solutions comprising, respectively, an acrylated monomer and an acrylated urethane to form a first oligomer mixture;

(b) applying said first oligomer mixture onto the surface of said machine element to form an adhesive layer, said applying step being performed during the performance of step (a);

(c) irradiating said adhesive layer with sufficient radiant energy to partially cure said adhesive layer;

(d) mixing a second pre-reacted reactive oligomer mixture comprising, respectively, liquid solutions an acrylated monomer, an acrylated urethane, and an acrylated polysiloxane;

(e) applying said second pre-reacted reactive oligomer mixture onto said adhesive layer to form a first release layer bonded with said adhesive layer; and (f) irradiating said adhesive and release layers with sufficient radiant energy to fully cure said adhesive and release layers.

2. The method defined in claim 1, further including the step of repeating step (e) until a sufficient number of release layers are applied to form a coating of a desired thickness.

3. The method of claim 2, wherein step (f) comprises irradiating said adhesive layer and said one or more release layers with ultraviolet light.

4. The method defined in claim 1, wherein step (a) is carried out at a temperature above 150° F.

5. The method of claim 1, wherein said first oligomer mixture further comprises at least one photoinitiator.

6. The method of claim 1, wherein said oligomer mixture of step (e) further comprises at least one photoinitiator.

7. A method of applying a release coating to the surface of a machine element, said method comprising the steps of:

(a) mixing liquid solutions of, respectively, an acrylated monomer, an acrylated urethane and an acrylated epoxy to form a first oligomer mixture;

(b) applying said first oligomer mixture onto the surface of said machine element to form an adhesive layer, said applying step being performed during the performance of step (a);

(c) irradiating said adhesive layer with sufficient radiant energy to partially cure said adhesive layer;

(d) applying a second pre-reacted reactive oligomer mixture onto said adhesive layer to form a first release layer bonded with said adhesive layer; and (e) irradiating said adhesive and release layers with sufficient radiant energy to fully cure said adhesive and release layers.

8. The method of claim 7, further including the step of repeating step (d) until a sufficient number of release layers are applied to form a coating of a desired thickness.

9. The method of claim 8, wherein step (e) comprises irradiating said adhesive layer and said one or more release layers with ultraviolet light.

10. The method of claim 7, wherein step (a) is carried out at a temperature above 150° F.

11. The method of claim 7, wherein said first oligomer mixture further comprises at least one photoinitiator.

12. The method of claim 7, wherein step (d) comprises mixing liquid solutions of, respectively, an acrylated monomer, an acrylated urethane, an acrylated epoxy, and an acrylated polysiloxane.

13. The method of claim 12, wherein said oligomer mixture of step (d) further comprises at least one photoinitiator.

* * * * *